United States Patent [19]

Kemp

[11] 4,410,373

[45] Oct. 18, 1983

[54] PROCESS FOR HEAT TREATMENT OF A METAL WORKPIECE

[76] Inventor: Willard E. Kemp, 1035 Dairy Ashford, Suite 146, Houston, Tex. 77079

[21] Appl. No.: 307,027

[22] Filed: Sep. 30, 1981

[51] Int. Cl.[3] ..... C21D 5/16; C21D 1/53

[52] U.S. Cl. ..... 148/16; 148/20.3; 148/131; 148/138; 432/15; 432/28

[58] Field of Search ..... 148/16, 16.5, 16.7, 148/20.3, 131, 130, 22; 432/15, 28

[56] References Cited

U.S. PATENT DOCUMENTS

| | | | |
|---|---|---|---|
| 1,042,999 | 10/1912 | Burian | 148/22 |
| 3,053,704 | 9/1962 | Munday | 148/20.3 |
| 3,099,589 | 7/1963 | Tanaka | 148/20.3 |
| 3,197,328 | 7/1965 | Jung et al. | 427/255.4 |
| 3,197,346 | 7/1965 | Munday | 148/20.3 |
| 3,336,167 | 8/1967 | Tanaka | 148/16.5 |
| 3,397,873 | 8/1968 | Ritchie et al. | 432/69 |
| 3,524,633 | 8/1970 | Schiller | 432/67 |
| 4,013,279 | 3/1977 | Virr | 266/249 |
| 4,222,429 | 9/1980 | Kemp | 164/34 |
| 4,249,889 | 2/1981 | Kemp | 432/11 |

*Primary Examiner*—L. Dewayne Rutledge
*Assistant Examiner*—Christopher W. Brody
*Attorney, Agent, or Firm*—Vaden, Eickenroht, Thompson, Bednar & Jamison

[57] ABSTRACT

A process for heat treatment of a metal workpiece, such as a casting (steel, aluminum based alloy or white cast iron). The casting is heated in a fluidized particulate bed (sand) to a relatively constant first temperature. Then, the casting is held (e.g., 3 hours) tightly packed against shape changes in the unfluidized bed until internal structural changes have occurred. Next, the casting is cooled in a fluidized particulate bed (sand) to a relatively constant second temperature. Then, the casting is held (e.g., 3 hours) tightly packed in the unfluidized bed until the desired internal structural changes are completed. The casting is removed from the bed for utilization as a heat treated product.

2 Claims, 2 Drawing Figures

PROCESS FOR HEAT TREATMENT OF A METAL WORKPIECE

BACKGROUND OF THE INVENTION

1. Field of the Invention

This invention pertains to the manufacture of metal castings, and more particularly, it relates to heat treatment of metal workpieces.

2. Description of the Prior Art

In the manufacture of metal workpieces, such as castings of steel, aluminum based alloys and white cast iron, the workpiece is subjected to various temperature and time defined changes so that certain desired internal structural changes will occur to improve the product. These changes can generally be grouped under heat treatment.

The heat treatment procedure usually involves a two step process wherein the workpiece is subject to a first temperature over a first time period and a second temperature over a second time period, and the rate of temperature changes between the first and second temperatures can also become important to effect the desired internal structural change in the workpiece.

For example, a steel casting is rapidly cooled to complete the internal structural transformation so that the product has a certain hardness, ductility, etc. Aluminum based alloys are heated to a first temperature, slowly cooled to a second temperature whereby the alloy constituents are dissolved and then, the hardener components precipitate from the alloy.

In the manufacture of malleable iron castings, the conventional practice is to melt a charge of pig iron and steel scrap, and then pour the charge into a suitable mold to produce a hard brittle white iron casting.

Although a very limited use can be made of white iron castings, the ductility of these products is essentially zero and mechanical/thermal stresses will result in material failures especially at sharp corners. Malleable iron is produced by annealing or graphitization of the white iron castings.

Malleable iron castings find commercial uses where strength, ductility, machinability and resistance to mechanical/thermal shock are important factors. The white iron castings have been made malleable by being placed into furnaces, and their temperature raised slowly to 1500° F.–1750° F., held there for a period of time, and then slowly cooled at a controlled rate. This procedure may extend for 50 or 100 hours even though the actual time required for the annealing or graphitization process is less than 15 hours so that the desired conversion occurs of the combined carbon to the "temper" carbon or graphite without cracking or distorting the castings. Naturally, the furnaces must have a special atmosphere (slightly reducing) to prevent corrosion and scale or the parts must be sealed in protective material.

The furnaces can be stationary batch-type or car-bottom type, and in some cases, the castings are placed into a static bedding (gravel) to minimize distortion or warping and cracking. Even with these precautions, castings with sections over 2 inches in thickness, or that weigh over 100 pounds, do not lend themselves presently to conversion into malleable iron castings except by experience and tedious furnace operations. The basic problem appears to reside in heating and cooling the casting throughout to a uniform temperature, and to maintain within a few degrees of temperatures in the critical range so as to convert the combined carbon of the white iron casting into graphite or "temper" carbon, and thus, to produce the desired ductile property in the casting.

One problem associated with the heat treatment of a metal workpiece at elevated temperatures is that external shape changes, such as working, occur simultaneously with the desired internal structural changes. It is one purpose of this invention to control and reduce the occurance of these external shape changes during the heat treatment of a metal workpiece.

SUMMARY OF THE PRESENT INVENTION

The present invention is a process for treating a metal workpiece by several unique steps. The workpiece is subjected to a fluidized bed until the workpiece reaches a certain temperature at which internal and external structural changes can occur. Then, fluidization of the bed is terminated. Now, the workpiece is packed in the bed for physically restraining the workpiece from changes in shape as by warping. The workpiece remains packed in the bed until the time and temperature dependent changes have occurred. Then, the workpiece is removed from the bed for subsequent utilization.

If desired, the workpiece can be subject to two separate series of these steps so that the internal and external changes can occur at two different temperatures, for different time periods, and the rates of temperature change can also be selected for a certain heat treatment result.

DESCRIPTION OF PREFERRED EMBODIMENT

The present process is applicable to many metal workpieces wherein heat treatment is applicable to produce internal structural changes for product improvement. Usually, the heat treatment involves heating the workpiece at two different temperatures, with heat-soaking time periods at these temperatures, and may include controlling the rate at which the change in temperatures occur in the procedure.

The present process can be used to heat treat a steel workpiece, such as a casting. The steel workpiece is first heated to above 1650° F. until it is uniformly at such temperature. Then, the workpiece is rapidly cooled to below 1300° F. and it may be held at such temperature for hours to complete the metal transformation for the desired product.

Similarly, the present process can be used to heat treat aluminum based alloy workpiece, such as a casting. The alloy workpiece is heated to about 750° F. until it is uniformly at such temperature. Then, the workpiece is slowly cooled to 500° F. and held uniformly at such temperature to complete the heat treatment change. This change occurs in two parts, at 750° F. the alloy constituents dissolve, and at 500° F. the hardener components will precipitate in the alloys. Then, the alloy workpiees can be utilized for its desired purpose.

Also, the present process is applicable in the makng malleable of white cast iron. This procedure will be described in more detail hereinafter.

In any of these heat treatment processes, a fluidized bed is used to change the temperature of the workpiece, and the rate of temperature change can be precisely controlled. In addition, the nonfluidized bed provides a constant temperature environment to heat soak the workpiece. Importantly, the workpiece is tightly packed in the nonfluidized bed for restraining physically the workpiece from changes in shape that occur simultaneously with the desired internal structural changes required in the heat treatment product.

Although the process will be described in detail for making malleable white cast iron, the procedural steps are equally applicable to other metal workpieces. However, the particular time and temperature conditions may vary somewhat from one metal to another.

The present process is practiced in a particulate bed, which is adapted to be (1) adjusted in temperature into the range between about 1200° F. and about 1750° F., (2) fluidized, (3) subjected to vibration or vacuum and (4) arranged for introduction of gases from an external source. The particulate bed is well known in the casting of metals, especially with thermally degrading molds. Reference may be taken to U.S. Pat. Nos. 4,222,429 and 4,249,889 issued to Willard E. Kemp which describes the use of particulate beds in metal casting and heat treating operations.

Figure 1:
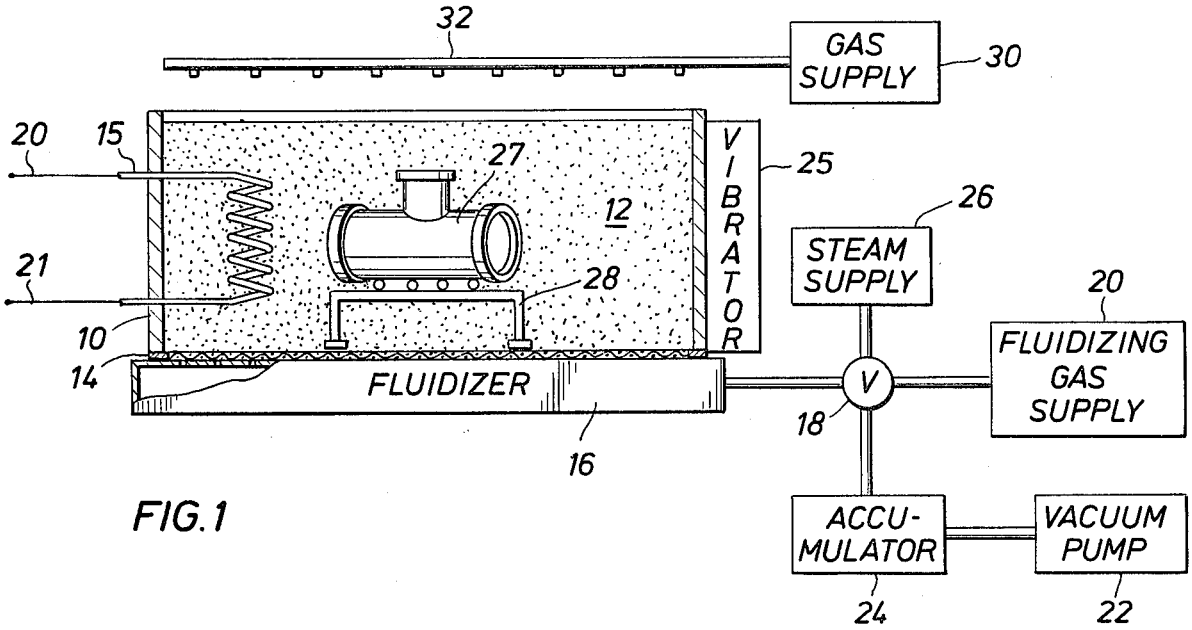
FIG. 1 is a schematic illustrating an apparatus which may be employed in practicing the present process.
Figure 2:
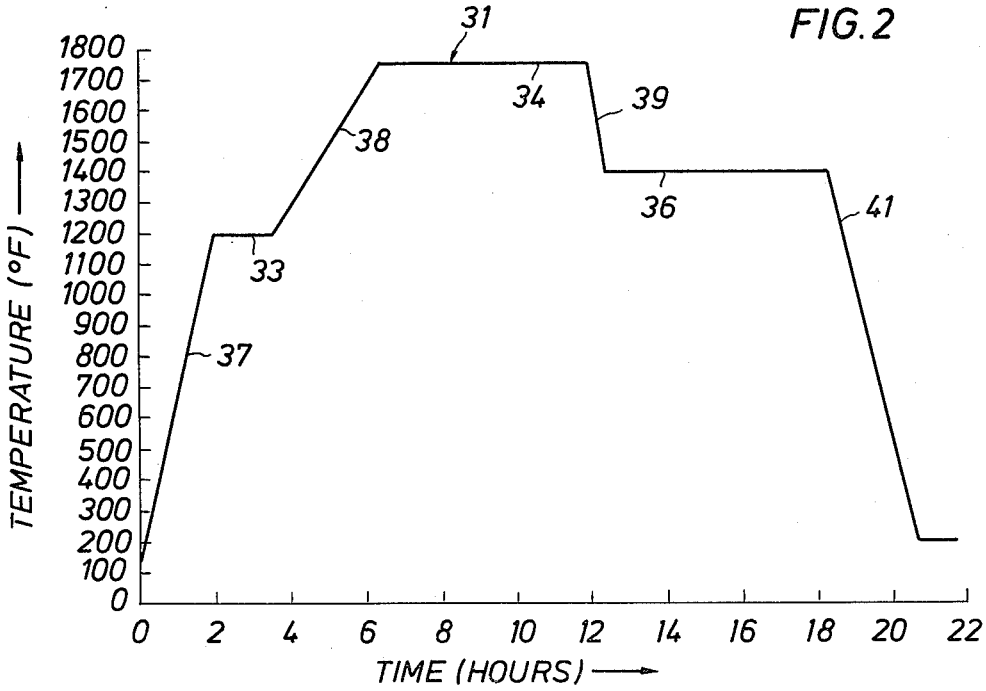
FIG. 2 is a time-temperature transformation curve of a typical white iron casting which is annealed into a malleable iron product in accordance with the present process.

In this embodiment of the present process, the white iron casting is shown as a large (200 pound) complex valve body which will be converted into a malleable iron product in the apparatus shown in FIG. 1. However, other malleable iron castings of different sizes and shapes may be produced with equal facility, and in other apparatus then will be specifically described herein.

As shown in FIG. 1, the casting container 10 is filled with the particulate bed 12, which may be sand, or other constituents. The container 10, is adapted to receive a flow of fluid, such as air, from a fluidizer 16 through a diffuser member such as a fine mesh screen 14.

A fluid source system is connected to the fluidizer 16, and provides for the flow of fluid upwardly through bed 12, or alternatively, aspirates fluid downwardly from the bed 12 into the fluidizer 16. For this purpose, the fluidizer 16 is connected through a selector valve 18 to a fluidizer gas supply 20, a source of vacuum or reduced pressure which includes an accumulator 24 and vacuum pump 22, and a source of heat energy or a coolant such as steam supply 26. The gas supply 20 is arranged to provide a suitable flow of pressurized fluid, such a air, which is passed upwardly through the bed 12 at a velocity of 100 feet per minute for large particle sizes and only about 3–30 feet per minute for small particle sizes. Stated in another manner, the flow of fluid in the bed provides a pressure drop of approximately 1 p.s.i. for each foot of depth in the bed 12. The bed 12 usually will be selected from particles with sizes between 30–250 mesh (American Foundry Screen).

The white iron valve body 27 is supported upon a framework 28 resting upon screen 14. Preferably, the valve body is placed into the bed when it is fluidized.

The bed 12 can be heated or cooled by fluid flow from the gas supply 20. Preferably, the bed is heated to elevated temperatures by a heat exchanger 15, which may be an electrical heater, receiving power from conductors 20 and 21. Also, initial heating may be provided by combustion gas introduced into the bed 12 through a manifold pipe 32 from a suitable gas supply 30. The manifold pipe 32 has a plurality of combustion nozzles so that combustion heating is applied directly to the bed 12. Also, the supply 20 may provide a combustible mixture into a priorly heated bed 12 so that surface or flameless combustion occurs insitu on the bed particle's surface. The heating of the bed may be accomplished by combining several of these heating mechanisms.

The bed 12 (when unfluidized) is tightly packed about the valve body 27 by using either aspirated fluid through the accumulator 24 or the vibrator 25. In some case the normal setting of the nonfluidized beds provides sufficient restraint to the body. As a result, the body is physically restrained from changes in shape, such as by warping, that occur simultaneously with the desired internal structural changes. With the nonfluidized bed 12 tightly packed about the valve body, it can remain for long periods in the heated bed without suffering warping, corrosion or scale problems since air is excluded for all practical purposes.

The fluidized bed 12 is a good heat conductive medium and is a superior heat conductor than the valve body 27. The bed particles exchange heat dynamically with the valve body 27. Initially, the flow of heat between the bed and the valve is at a high rate which decreases as the bed and valve body approach the same temperature. Because of the efficient transfer of heat from a fluidized bed to a metal part, the bed and valve body quickly reach the same temperature. Most importantly, the fluidized bed 12 is generally at a uniform temperature irrespective of its use in heating or cooling the valve body.

The bed 12, when not fluidized, has a very low thermal conductivity. Therefore, a near equilibrium condition is quickly reached in a thin layer (e.g., one-half inch) in the bed about the valve body. Thus, if the bed and valve body begin a "heat soak" period, the valve will remain at a relatively constant temperature for greatly extended periods of time. For example, the bed 12 at 1750° F. may let the valve body cool only about 50° F. over a 5 hour period.

Although the present bed 12 is adapted for both heating and cooling operation, a plurality of the beds may be employed, each bed adjusted to a certain temperature for annealing the white iron valve body as will be described hereinafter. Obviously, the valve body 27 would be transferred between these beds in the stepwise practice of the present process.

As an initial step, the bed 12 is fluidized and heated to a temperature of about 1750° F. with the valve body 27 mounted upon the framework 28. Within a short period of time, the valve body is heated uniformly to substantially this temperature of the bed. Usually, the temperature can be precisely controlled to the desired level but a few degrees of variation will not be disasterous because of the bed's function in heating the valve body uniformly to the bed's temperature. Corrosion and scale formation on the valve body is not a problem in the fluidized bed because of the short duration of fluidization (e.g., less than one-half hour).

Now, fluidization of the bed is terminated and the casting rests or heat soaks, therein for a period of several hours (e.g., 3 to 10 hours). The bed 12 is tightly packed about the valve body by use of the vibrator 25, the accumulator 24, or both mechanisms. As a result, the valve body remains physically restrained against shape changes at a relatively constant temperature of about 1750° F. whereby the combined carbon undergoes graphitization in the white iron valve body 27.

With the valve body in place on the framework 28, the bed 12 is fluidized while being cooled to a temperature of about 1400° F. The valve body 27 is cooled rapidly and uniformly throughout to substantially the bed temperature. Again, this step occurs quickly (e.g., less than one-half hour) and no significant corrosion or scale can form on the valve body.

Now, fluidization of the bed is terminated and the casting rests or heat soaks, therein for a period of several hours (e.g., 6 to 12 hours). Again, it is preferred to have the bed 12 tightly packed about the valve body 27. As a result, the valve body remains physically restrained against shape changes at a relatively constant temperature of about 1400° F. for a sufficient time period to achieve the desired conversion of combined carbon into graphite in the casting.

At the heat soak end, the valve body is a malleable iron product and can be removed from the bed for subsequent machining, etc.

If the casting is massive, large in webs or complex, or for other reasons, the initial step of this process may be modified by first heating white iron casting in the fluidized bed to about 1200° F. Then, the fluidization of the bed may be terminated so that the valve body uniformly is heated to about 1200° F. Now, the bed is fluidized and heated slowly to the temperature of about 1750° F. The rate of temperature increase is regulated to avoid warping and cracking of the valve body. Usually, this temperature increase from about 1200° F. to about 1750° F. should take between one and two hours, and the exact time span depends somewhat on the mass and complexity of the casting.

It is sometimes desired that the mass of the bed 12 be sufficiently greater than the cast valve body that the temperature of the bed remains relatively constant as the casting temperature approaches it during bed fluidization. Thus, the heat capacity of the valve body cannot significantly change the temperature of the bed 12.

In the heating or cooling of the valve body 27, the desired temperature at the critical level (e.g., 1200° F., 1750° F., 1400° F.) can be precisely provided by the large heat sink of the particulate bed. The bed's fluidization can be controlled to provide a uniform rate of temperature change in regulated and uniform heat transfer between the valve body and the bed. This temperature change can be made to occur within a selected period of time for providing the temperature-time transform curve represented by a solid line 31. In accordance with the present process, the valve body may be treated under such precise conditions that its temperature-time transformation curve is substantially extending in time only for the actual period required to convert the combined carbon to graphite in the white iron valve body 27.

The curve 31 illustrates the precise change in temperature levels at uniform rates by the straight line function of the sloped parts, when the casting is being heated or cooled in the fluidized bed. Also, the curve 31 illustrates the uniform temperature maintainance by the straight line function of the horizontal parts when the cast valve body is in a "heat soaking" period in the bed under quiscent state conditions.

More particularly, the horizontal parts 33, 34 and 36 of the curve 31 at 1200° F., 1750° F. and 1400° F. reflect the actual minimum time required to safely convert the combined carbon to graphite in the cast valve body 27. However, the slope parts 37, 38, 39 and 41 of the curve 31 show the fast but uniform changes in increasing and decreasing temperatures provided in the casting by the fluidized bed 12. It is apparent that the valve body 27 can be safely heated and cooled very quickly from ambient temperatures by the sloping parts 37 and 41.

As a further explanation of the curve 31, the size of the bed relative to the cast valve body may be arranged so that the heat capacity of the bed is several fold greater than that of the valve body. As a result, the transfer of heat between the bed and the valve, is such that the temperature of the particulate material changes relatively slightly while the temperature of the valve is brought from one level to another.

From the foregoing, it will be apparent that there has been provided a process for heat treatment of a metal workpiece that can produce a desired treatment result with greater efficiency, superior control in both temperature and time than related furnace procedures which have been employed up to the present time. In addition, the present invention requires the very minimal manual manipulations of the workpiece. It will be understood that certain features and alterations of the present process may be employed without departing from the spirit of this invention. These changes are contemplated by and are within the scope of the appended claims. It is intended that the present description be taken as an illustration of a preferred embodiment of the present process.

What is claimed is:

1. A process for malleabilizing a white iron casting, comprising the steps of:

(a) subjecting the casting to a fluidized particulate bed at a temperature of about 1750° F. until the casting is heated throughout to substantially this temperature;

(b) terminating fluidization of the bed and leaving the casting therein for a period of several hours whereby the casting remains packed in a bed at a relatively constant temperature of about 1750° F. as its combined carbon undergoes graphitization;

(c) subjecting the casting to a fluidized particulate bed at a temperature of about 1400° F. until the casting is cooled rapidly throughout to substantially this temperature;

(d) terminating fluidization of the bed and leaving the casting packed therein tightly to prevent changes in the external shape and at a relatively constant temperature of about 1400° F. for a sufficient time period for completing the desired conversion of its combined carbon to graphite;

(e) removing the casting from the bed for subsequent utilization; and (f) wherein in steps (b) and (d), each bed is subject to vibration to tightly pack the bed material about the casting therein.

2. A process for malleabilizing a white iron casting, comprising the steps of:

(a) subjecting the casting to a fluidized particulate bed at a temperature of about 1750° F. until the casting is heated throughout to substantially this temperature;

(b) terminating fluidization of the bed and leaving the casting therein for a period of several hours whereby the casting remains packed in the bed at a relatively constant temperature of about 1750° F. as its combined carbon undergoes graphitization;

(c) subjecting the casting to a fluidized particulate bed at a temperature of about 1400° F. until the casting is cooled rapidly throughout to substantially this temperature;

(d) terminating fluidization of the bed and leaving the casting packed therein tightly to prevent changes in its external shape and at a relatively constant temperature of about 1400° F. for a sufficient time period for completing the desired conversion of its combined carbon to graphite;

(e) removing the casting from the bed for subsequent utilization; and (f) wherein in steps (b) and (d), each bed is subject to a reduced pressure condition to tightly pack the bed material about the casting therein.

* * * * *